US010154350B2

(12) United States Patent
Meng

(10) Patent No.: US 10,154,350 B2
(45) Date of Patent: Dec. 11, 2018

(54) MICRO-SPEAKER USING SLOPE FOR CONNECTING A FIRST PORTION AND A SECOND PORTION OF THE BASE WALL TO AVOID LEAD BUMPING

(71) Applicants: AAC Acoustic Technologies (Shenzhen) Co., Ltd., Shenzhen (CN); AAC Microtech (Changzhou) Co., Ltd., Changzhou (CN)

(72) Inventor: Yiming Meng, Shenzhen (CN)

(73) Assignees: AAC ACOUSTIC TECHNOLOGIES (SHENZHEN) CO., LTD., Shenzhen (CN); AAC MICROTECH (CHANGZHOU) CO., LTD., Changzhou, Jiangsu Province (CN)

( * ) Notice: Subject to any disclaimer, the term of this patent is extended or adjusted under 35 U.S.C. 154(b) by 0 days.

(21) Appl. No.: 15/955,787

(22) Filed: Apr. 18, 2018

(65) Prior Publication Data

US 2018/0234772 A1 Aug. 16, 2018

Related U.S. Application Data

(63) Continuation of application No. 14/147,133, filed on Jan. 3, 2014, now abandoned.

(51) Int. Cl.
*H04R 9/06* (2006.01)
*H04R 7/18* (2006.01)
(Continued)

(52) U.S. Cl.
CPC ..... *H04R 9/06* (2013.01); *H04R 1/06* (2013.01); *H04R 7/12* (2013.01); *H04R 7/18* (2013.01);
(Continued)

(58) Field of Classification Search
CPC .... H04R 1/06; H04R 1/2884; H04R 2400/11; H04R 9/06; H04R 9/025; H04R 11/02; H04R 7/18
See application file for complete search history.

(56) References Cited

U.S. PATENT DOCUMENTS 8,995,704 B2 * 3/2015 Huang ..... H04R 9/043 181/171
9,686,614 B2 * 6/2017 Meng ..... H04R 9/025
(Continued)

FOREIGN PATENT DOCUMENTS

JP 2004128822 * 4/2004

*Primary Examiner* — Fan S Tsang
*Assistant Examiner* — Angelica M McKinney
(74) *Attorney, Agent, or Firm* — Na Xu; IPro, PLLC

(57) ABSTRACT

A micro-speaker is disclosed. The micro-speaker includes a frame with a hollow space, a diaphragm attached to the frame, a voice coil with a lead, a yoke received in the hollow space, a magnet received in the yoke. The yoke includes a base wall in shape of rectangle with two long boundaries and two short boundaries. The base wall includes a first portion locating at the middle of the base wall and two second portions locating at two ends of the first portion and extending to the two short boundaries respectively. The first portion has a thickness greater than the second portion. The second portion of the base wall provides an extra space for at least part of the lead so as to avoid the lead bumping against the base wall.

4 Claims, 3 Drawing Sheets

(51) Int. Cl.
*H04R 1/06* (2006.01)
*H04R 7/12* (2006.01)
*H04R 9/02* (2006.01)

(52) U.S. Cl.
CPC ..... *H04R 9/025* (2013.01); *H04R 2400/11* (2013.01); *H04R 2499/11* (2013.01)

(56) References Cited

U.S. PATENT DOCUMENTS

2002/0071590 A1* 6/2002 Han ..... H04R 9/025
381/412
2011/0051987 A1* 3/2011 Ueda ..... B06B 1/045
381/412
2011/0293121 A1* 12/2011 Yan ..... H04R 7/04
381/191

* cited by examiner

MICRO-SPEAKER USING SLOPE FOR CONNECTING A FIRST PORTION AND A SECOND PORTION OF THE BASE WALL TO AVOID LEAD BUMPING

RELATED PATENT APPLICATION

This application is a continuation-in-part of U.S. patent application Ser. No. 14/147,133, filed Jan. 3, 2014, entitled "micro-speaker", currently pending.

FIELD OF THE INVENTION

The present disclosure relates to transducers to be mounted in terminal equipment for converting electrical signals to audible sounds, and more particularly to a micro-speaker.

DESCRIPTION OF RELATED ART

Sound which can be heard by a person's auditory sense is transmitted in the form of waves. The sound having the wave form moves air molecules and vibrates the tympanic membrane, thus allowing a person to hear the sound. In order to provide audible sounds, various kinds of speakers have been developed. The speaker is generally coupled to audio equipment or an amplifier for use as a large sound producing means for considerably amplifying volume. Alternatively, the speaker may be used as a small sound producing means having small size and volume.

As such, the small-sized speaker may be mounted to a small electronic product, such as a mobile phone, a PDA, or a notebook computer. As the wireless age begins, consumers want to consume various contents regardless of time and place and demand portability. In order to satisfy the consumers' desires, speakers are tending towards miniaturization and lightness.

A micro-speaker related to the present disclosure includes a case defining a sound hole, a frame attached to the case for forming a chamber, a magnetic circuit defining a magnetic gap, a diaphragm located in the chamber, and a voice coil attached to the bottom of the diaphragm. Typically, the magnetic circuit includes a yoke, a magnet positioned on the yoke, and a top plate attached to the magnet. The magnetic gap is formed between the yoke and the magnet, and the voice coil is suspended in the magnetic gap. While electrified, the voice coil will be activated to vibrate by the electromagnetic Ampere Force and further drives the diaphragm to vibrate, which converts the electrical signals to sound waves.

However, as mentioned above, as the micro-spacer is designed smaller and thinner, no extra space is provided for the voice coil lead extending from the lower end of the voice coil. In many cases, the voice coil lead even will collide to the bottom of the yoke so as to badly affect the frequency sound quality produced by the diaphragm.

Therefore, it is desirable to provide a micro-speaker which can overcome the above-mentioned problems.

Figure 1:
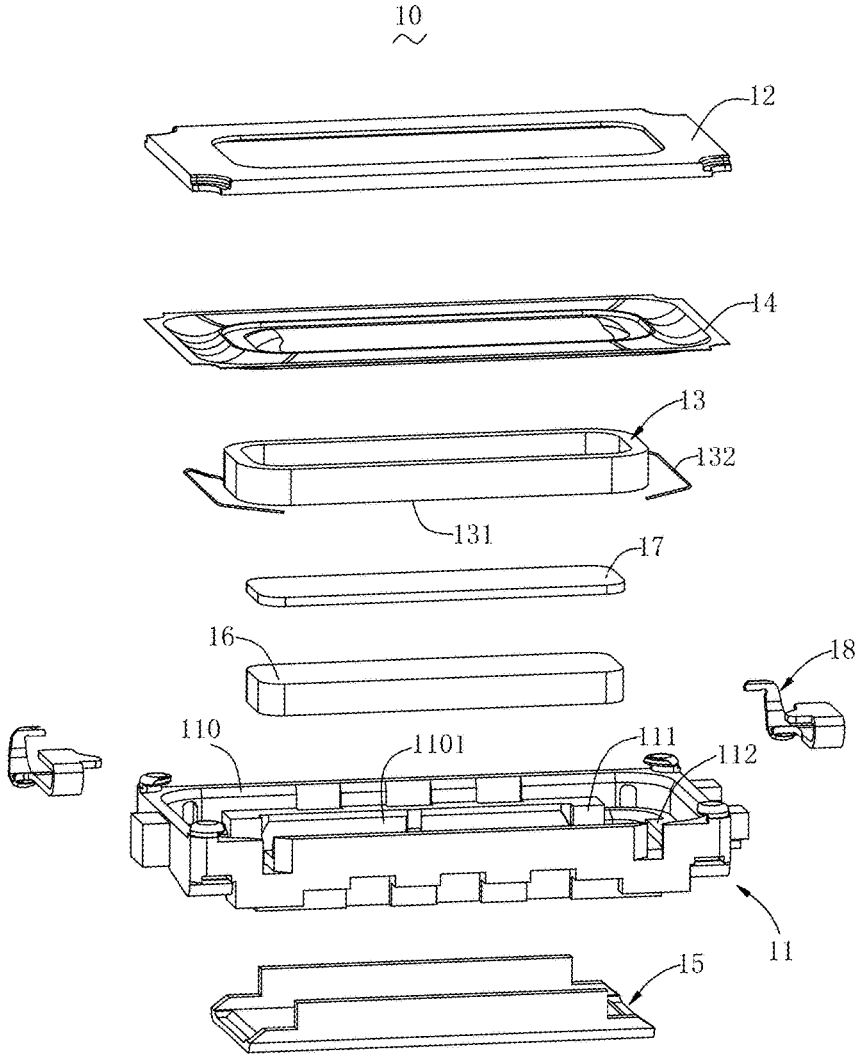
FIG. 1 is an isometric exploded view of a micro-speaker in accordance with an exemplary embodiment of the present disclosure.

Many aspects of the embodiment can be better understood with reference to the drawings mentioned above. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

Reference will now be made to describe exemplary embodiments of the present disclosure in detail.

Figure 2:
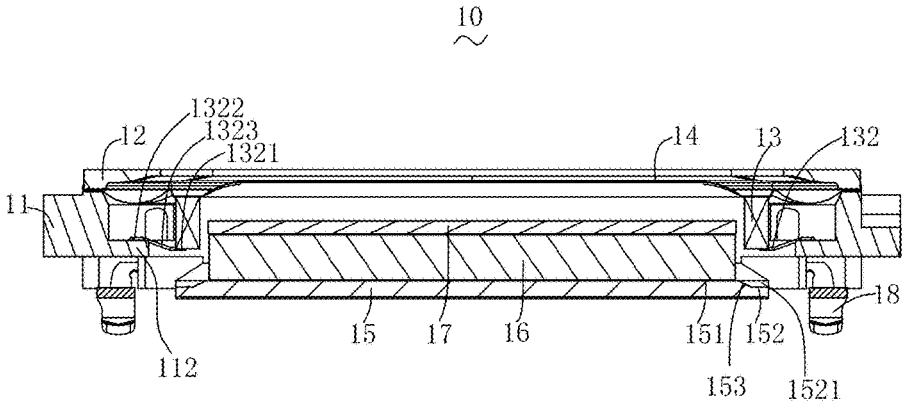
FIG. 2 is an illustrative cross-sectional view of the micro-speaker in FIG. 1.
Figure 3:
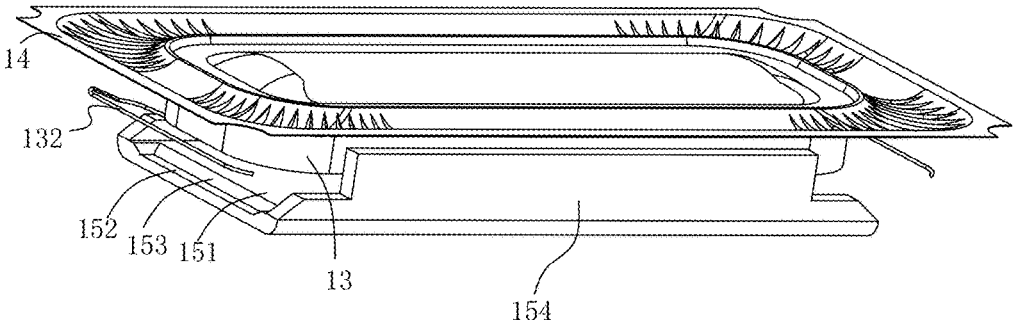
FIG. 3 is an isometric view of the micro-speaker in FIG. 1, with a housing thereof being removed away.
Figure 4:
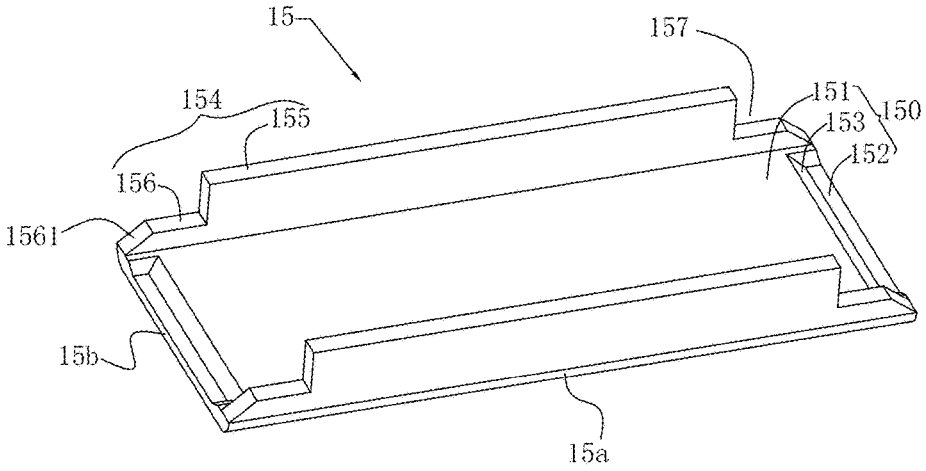
FIG. 4 is an isometric view of a yoke of the micro-speaker in FIG. 1.
Figure 5:
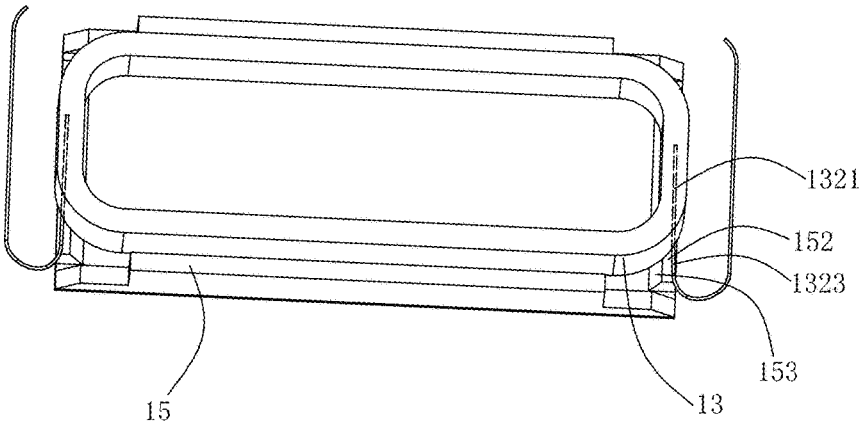
FIG. 5 is an isometric view of an assembly of a yoke and a voice coil of the micro-speaker in FIG. 1.

Referring to FIGS. 1-5, an exemplary embodiment of the present invention discloses a micro-speaker 10 comprising a frame 11 forming a hollow space 1101 by a plurality of inner sidewalls 110, a diaphragm 14 attached to the inner sidewalls 110 of the frame 11, a cover 12 covering the diaphragm 14 and attached to the frame 11, a yoke 15 engaged with the frame 11, a magnet 16 received in the yoke 15, a pole plate 17 attached on the magnet 16, and a voice coil 13 activating the diaphragm 14. Further, a pair of conductive terminals 18 is provided in the frame electrically connected to leads 132 of the voice coil 13. Thus, the voice coil 13 can receive electrical signals via the conductive terminals 18. A magnetic gap is formed between the yoke 15 and the magnet 16. In addition, the frame 11 further defines a plurality of positioning portions 111 extending from inner sidewalls 110 thereof and received in the hollow space 1101.

In particularly, the frame 11, cooperatively with the cover 12 forming a housing, defines a chamber therebetween for receiving the yoke 15, the magnet 16, the pole plate 17, the voice coil 13 and the diaphragm 14 therein. One end of the voice coil 13 is connected directly or indirectly with the diaphragm 14, the other end of the voice coil 13 is at least partially received in the magnetic gap. The frame 11 further includes a pair of fences 112 extending from inner sidewalls 110 of the frame 11 and received in a hollow space 1101 for embedding the pair of conductive terminals 18 in proper position so as to electrically connect with the leads 132 of the voice coil 13. In the embodiment, the leads 132 extend from the lower end 131 of the voice coil 13 far away from the diaphragm 14. While electrified, the voice coil 13 is activated to move by Lorenz Force, and accordingly, the diaphragm 14 is driven by the voice coil 13, which produces sound waves.

The yoke 15 includes a base wall 150 in shape of rectangle with two long boundaries 15*a* corresponding to each other and two short boundaries 15*b* corresponding to each other, and only two sidewalls 154 extending upwardly and perpendicularly from the two long boundaries 15*a* of the base wall 150 respectively. The base wall 150 comprises two portions located between the two sidewalls 154 of the yoke 15, where a first portion 151 locates at the middle of the base wall 150 and two second portions 152 locate at two ends of the first portion 151 and extending to the two short boundaries 15*b* respectively. A thickness of the first portion 151 is greater than that of the second portion 152. The base wall 150 further comprises a slope 153 connecting the first portion 151 and the second portion 152. The magnet 16 is installed on the first portion 151 and forms the magnetic gap together with the two sidewalls 154 of the yoke 15.

Each of the sidewalls 154 comprises a main wall 155 and a pair of auxiliary walls 156 extending from two ends of the main wall 155 respectively. A height of the main wall 155 is greater than that of the auxiliary wall 156. Each auxiliary wall 156 comprises an inclining portion 1561 extending to the short boundary 15*b*. The inclining portion 1561 aligns with the second portion 152 of the base wall 150.

Accordingly, each of the sidewalls 154 further comprises a pair of nicks 157 formed by the main wall 155 and the auxiliary walls 156 for engaging with the positioning portions 111 for positioning the frame 11.

Each lead 132 of the voice coil 13 comprises a first part 1321 connected to the lower end 131 of the voice coil 13, a second part 1322 connected to the conductive terminal 18, and a connection part 1323 connecting the first part 1321 and the second part 1322. The second portion 152 of the base wall 150 provides an extra space 1521 for at least part of the lead 132 so as to avoid the lead 132 bumping against the base wall 150. Optionally, the first part 1321 of the voice coil 13 may correspond to the second portion 152 of the base wall 150, further, at least part of the connection part 1323 may correspond to the second portion 152 of the base wall 150.

While the present disclosure has been described with reference to the specific embodiments, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. A micro-speaker, comprising:

a frame forming a hollow space by a plurality of inner sidewalls;

a diaphragm attached to the inner sidewalls;

a pair of conductive terminals attached to the frame;

a yoke received in the hollow space, the yoke comprising a base wall in shape of rectangle with two long boundaries corresponding to each other and two short boundaries corresponding to each other, and only two sidewalls extending upwardly and perpendicularly from the two long boundaries of the base wall respectively;

a magnet received in the yoke;

a voice coil activating the diaphragm; wherein the base wall comprises three portions located between the two sidewalls of the yoke, where a first portion locates at the middle of the base wall and two second portions locate at two ends of the first portion and extend to the two short boundaries respectively, a thickness of the first portion is greater than that of each of the second portions, the base wall further comprises a slope connecting the first portion and one of the second portions and another slope connecting the first portion and the other second portion, the magnet is installed on the first portion and forms a magnetic gap together with the two sidewalls of the yoke, the voice coil comprises two leads each being corresponding to a conductive terminal and extending from the lower end of the voice coil far away from the diaphragm, each of the second portions of the base wall provides an extra space for at least part of an adjacent lead for avoiding the leads bumping against the base wall, each sidewall of the yoke comprises a main wall and two auxiliary walls extending from two ends of the main wall respectively, a height of the main wall is greater than that of each of the auxiliary walls, a pair of nicks is formed by the main wall and the auxiliary walls for engaging with the frame, each auxiliary wall comprises an inclining portion extending to an adjacent short boundary, the inclining portion aligns with an adjacent second portion of the base wall.

2. The micro-speaker as described in claim 1, wherein each lead comprises a first part connected to the lower end of the voice coil, a second part connected to a corresponding conductive terminal, and a connection part connecting the first part and the second part, the first part corresponds to an adjacent second portion of the base wall.

3. The micro-speaker as described in claim 2, wherein at least part of the connection part corresponds to an adjacent second portion of the base wall.

4. The micro-speaker as described in claim 1, wherein the frame comprises positioning portions extending from the inner sidewalls of the frame for engaging with the nicks.

* * * * *